US009683437B2

(12) United States Patent
Flanigan et al.

(10) Patent No.: US 9,683,437 B2
(45) **Date of Patent: *Jun. 20, 2017**

(54) METHOD OF SIGNALING PASSAGE OF OBJECTS USING TATTLE-TALE APPARATUS

(71) Applicant: BLACKHAWK SPECIALTY TOOLS, INC., Houston, TX (US)

(72) Inventors: Kenneth Flanigan, Yucaipa, CA (US); James F. Giebeler, San Bernardino, CA (US); Juan Carlos E. Mondelli, Houston, TX (US); Ron D. Robichaux, Houma, LA (US)

(73) Assignee: Blackhawk Specialty Tools, LLC, Houston, TX (US)

( * ) Notice: Subject to any disclaimer, the term of this patent is extended or adjusted under 35 U.S.C. 154(b) by 381 days.

This patent is subject to a terminal disclaimer.

(21) Appl. No.: 14/482,709

(22) Filed: Sep. 10, 2014

(65) Prior Publication Data

US 2014/0374092 A1 Dec. 25, 2014

Related U.S. Application Data

(63) Continuation of application No. 12/932,647, filed on Mar. 2, 2011, now Pat. No. 8,887,799.

(60) Provisional application No. 61/309,934, filed on Mar. 3, 2010.

(51) Int. Cl.

| | |
|---|---|
| ***E21B 47/12*** | (2012.01) |
| ***E21B 33/05*** | (2006.01) |
| ***E21B 47/09*** | (2012.01) |

(52) U.S. Cl.

CPC ..... *E21B 47/12* (2013.01); *E21B 33/05* (2013.01); *E21B 47/09* (2013.01)

(58) Field of Classification Search

CPC ..... E21B 47/09; E21B 47/0905; E21B 23/08; E21B 34/14; E21B 33/05; F16L 55/48; B65G 51/36; B65G 51/38; H01H 36/008; H01H 36/0013

See application file for complete search history.

(56) References Cited

U.S. PATENT DOCUMENTS 4,658,646 A * 4/1987 Bell ..... H01H 36/0073 73/865.8

* cited by examiner

*Primary Examiner* — Cathleen Hutchins
(74) *Attorney, Agent, or Firm* — Ted M. Anthony

(57) ABSTRACT

An electro-mechanical indicator system for signaling when a droppable object (such as, for example, a dart, plug or ball) is released during well cementing operations. A body section has first and second chambers divided by a fluid and pressure sealing barrier. A mechanical trigger mechanism is situated in the first chamber, which is exposed to elevated pressures and harsh wellbore fluids. Less robust components, such as sensor(s), power source(s), and signal device(s) located in the second chamber, remain isolated from the wellbore environment and elevated pressures.

11 Claims, 5 Drawing Sheets

METHOD OF SIGNALING PASSAGE OF OBJECTS USING TATTLE-TALE APPARATUS

CROSS REFERENCES TO RELATED APPLICATION

This application is a continuation of application Ser. No. 12/932,647, filed Mar. 2, 2011, currently pending, which claims priority from U.S. Provisional Patent Application Ser. No. 61/309,934 filed Mar. 3, 2010.

STATEMENTS AS TO THE RIGHTS TO THE INVENTION MADE UNDER FEDERALLY SPONSORED RESEARCH AND DEVELOPMENT

NONE

BACKGROUND OF THE INVENTION

1. Field of the Invention

The present invention relates to an indicator system for use in oil and gas operations. More particularly, the present invention pertains to an electro-mechanical indicator system for signaling when a droppable object (such as, for example, a dart, plug or ball) is released during well cementing operations.

2. Brief Description of the Prior Art

Conventional rotary drilling rigs typically comprise a supportive rig floor incorporating a rotary table, a substantially vertical derrick extending above said rig floor, and a traveling block or other hoisting mechanism that can be raised and lowered within said derrick. During drilling or servicing operations, such rig equipment is often used to manipulate tubular goods (such as drill pipe), through the rotary table and in and out of a well bore extending into the earth's crust. Once a well has been drilled to a desired depth, large diameter pipe called casing is frequently installed in such well and cemented in place. The casing is typically installed to provide structural integrity to a well bore, and to keep geologic formations isolated from one another.

When conventional drilling rigs are used, casing is typically inserted into a well in a number of separate sections of substantially equal length. Single sections of pipe called "joints," are typically screwed together or otherwise joined end-to-end at the rig in order to form a substantially continuous "string" of pipe that reaches downward into the earth's surface. As the bottom or distal end of the pipe string penetrates further into a well, additional sections of pipe are added to the ever-lengthening pipe string at the rig.

Conventional casing operations typically involve specialized crews and equipment mobilized at a rig site for the sole purpose of running casing into a well. With conventional casing operations, powered casing tongs, casing elevators and spiders, and at least one dedicated hydraulic power unit are typically required to be mobilized to a well location and installed just prior to such casing operating. Specialized casing crews must rig up and operate the equipment, connect the joints of casing to run in the well, and demobilize the equipment following completion of the job.

Top drive systems, which can be used to pick up sections of pipe, connect pipe sections together, and provide the torque necessary to drill wells, have been used on drilling rigs for some time to make-up drill pipe connections and to efficiently drill wells. Until relatively recently, it has been a challenge to develop a viable method of using top drives systems to make-up and run casing strings, just as strings of drill pipe have historically been run. However, a method of running casing using a rig's top drive system together with a casing running tool (CRT) has become increasingly popular in recent years.

During casing running operations, especially those conducted using CRT's, specialized equipment known as cement heads are frequently utilized. Such cement heads should beneficially permit cement slurry to flow from a pumping assembly into a well, and should have sufficient flow capacity to permit high pressure pumping of large volumes of cement and other fluids at high flow rates. Such cement heads should also have sufficient tensile strength to support heavy weight tubulars extending from the surface into a well, and to accommodate raising and lowering of such tubular goods without interfering with and/or intermittently stopping longitudinal and/or rotational movement of a casing string.

Droppable objects, such as a dart, balls, plugs and/or other objects, which are typically constructed of rubber, plastic or other material, are frequently pumped into a well in connection with cementing operations. In many instances, such items are suspended within a cement head until the objects are released or "launched" at desired points during the cement pumping process. Once released, such items join the cement slurry flow and can be pumped down hole directly into a well. Such darts, balls, plugs and/or other objects should be beneficially held in place within the slurry flow passing through the cement head prior to being launched or released without being damaged or washed away by such slurry flow. Further, it is critically important to know when such droppable objects have been successfully launched and cleared the cement head, entering the wellbore below such cement head.

Indicator systems for detecting passage of such droppable objects, commonly known in the industry as "tattle tales," have been developed for this purpose. Tattle tales are frequently used on cement heads to indicate that droppable objects such as a darts, plugs, balls or other objects have been released from a stationary position, passed through a cement head, and entered into the well below.

During well cementing operations, it is imperative that an operator must recognize that a droppable object is actually released, as well as the precise time when it is released. An absence of a positive indication of such release can be a serious problem. By way of example, but not limitation, failure to know when a plug is released can lead to miscalculation of a volume of cement needed to be pumped downhole through a cement head in order to adequately cement casing in place.

A challenge exists in finding a suitable sealing arrangement between the extremely harsh environment of the interior of a well, which can have fluids flowing at rates as high as eight barrels a minute with pressures of up to 15,000 PSI, and the atmospheric pressure encountered outside of the cement head. Moreover, wellbore fluids can be drilling mud or cement, which are typically non-homogeneous and difficult to seal against.

Prior art cementing heads typically utilize a mechanical lever-actuated indicator or tattle tale to indicate passage of a cementing plug from a plug holder within a cement head. In some instances, such prior art mechanical lever-actuated plug release indicators may erroneously signal the passage of a cementing plug from a cementing plug container within a cement head, even though such plug is still contained within the container. Such erroneous indications can ruin an otherwise effective cement job due to over displacement of cement.

Another type of prior art tattle tale utilizes a radioactive nail or other source incorporated into a cementing plug. When a cementing plug having a radioactive signature is no longer present in the cementing plug container (that is, after it is released), a radiation measuring instrument, such as a Geiger counter or the like, will indicate that the plug is no longer in the cementing plug container in the cement head. However, because the shelf life of readily available and easily handled radioactive nails is limited, such nails may be difficult to obtain and store, especially when working in remote areas.

Additionally, acoustic-type plug release indicators have also been used to indicate release of droppable objects. Such devices utilize at least one microphone to detect the sound of an object moving through well casing and transmit a signal to a listening system and, frequently, a magnetic tape recorder.

Yet another type of prior art tattle tale device uses a micro-switch or a reed magnetic switch. Both devices, unless carefully sealed, have the potential for causing a spark either when the switch closes or opens. Moreover, the switch contacts can become fouled and not allow a path for electrical current to flow when the switch is closed. Vibration in a drilling rig can also cause very sensitive contacts of such switches to make false contact or partial contact, thereby causing high resistance abnormalities in the circuit. Finally, this mechanical type of switch requires mechanical penetration and communication between a high pressure, hostile environment within a wellbore, and the environment outside the cement head where an indication must be observable.

Existing prior art indicator devices all suffer from significant operational and performance limitations. Thus, it is desirable to find a suitable means for transferring sensed data from the inner flow bore of a cement head through a suitable barrier or sealing means to an indicating device outside of said cement head. The indicator should reliably and consistently signal passage of a droppable object within said flow bore of a cement head.

SUMMARY OF THE PRESENT INVENTION

The present invention is an indicator used in cement heads and other similar equipment that utilizes droppable objects such as, for example, darts, wiper balls, plugs and/or the like. Such droppable objects can be held in place within the cement head until launching of said objects is desired. Once launched, such plugs or other items can move downward into a wellbore below; such plugs or other items are motivated into such wellbore through gravity feed, as well as fluid pressure exerted from above. As fluid gathers on top and around a launched object, pressure increases above such object, thereby forcing the object downward from a cement head into the well bore below.

The present invention comprises an indicating device, commonly known as a tattle tale, having a body with a mechanical trigger that is at least partially received within a central flow bore of a cement head. When a released object passes the indicating device of the present invention, said mechanical trigger rotates. Such rotation moves a magnet within range of a sensor that can determine the presence of a magnetic field. In the preferred embodiment, said sensor is located in a separate chamber isolated from the wellbore environment, preferably by a substantially continuous mechanical, non-magnetic barrier that contains no moving parts, thus no dynamic seals, and no penetrations. Such separate chamber can beneficially house a power supply, electronics, LED's, and/or an audio indicating device. Among other functions, such electronics can beneficially sustain the output signal of the indicating device(s) for a predetermined period of time after an event occurs.

BRIEF DESCRIPTION OF THE DRAWINGS

The foregoing summary, as well as the following detailed description of the preferred embodiments, is better understood when read in conjunction with the appended drawings. For the purpose of illustrating the invention, the drawings show certain preferred embodiments. It is understood, however, that the invention is not limited to the specific methods and devices disclosed. Further, dimensions, materials and part names are provided for illustration purposes only and not limitation.

DRAWINGS-Reference Numerals

| | | | |
|---|---|---|---|
| 1 | light housing nut | 2 | light housing |
| 3 | body | 4 | switch |
| 5 | slots | 6 | lock nut |
| 7 | boot | 8 | circulation loss wire tongue |
| 9 | printed circuit board (PCB) | 10 | polycarbonate lens |
| 11 | piezo buzzer | 12 | positioning sleeve |
| 13 | battery compartment cover | 14 | battery compartment |
| 15 | ¼-20 flat head socket screw | 16 | 141 o-ring |
| 18 | hinge pin | 20 | hinge |
| 22 | nose | 24 | Hall effect sensor assembly |
| 26 | hinge cap | 28 | spiral retaining ring |
| 30 | 6-32 flat head socket screw | 32 | ⅛" roll pin |
| 34 | retaining wire | 36 | 2-218 o-ring |
| 38 | 8-218 back-up ring | 40 | ¼" roll pin |
| 42 | 2-224 o-ring | 44 | 8-224 back-up ring |
| 46 | magnet | 48 | circular retaining ring |
| 50 | standard wire tongue | | |

DETAILED DESCRIPTION OF A PREFERRED EMBODIMENT OF THE INVENTION

Cement heads are frequently mounted a significant distance above a rig floor. In such instances, personnel must typically be lifted off the rig floor to an elevated location using a makeshift seat or harness attached to a hoist or other lifting device in order to permit such personnel to physically access said cement head in order to launch droppable objects such as darts, balls, plugs or other items, as well as to verify that such objects have actually been effectively launched and have actually cleared the cement head. It is frequently beneficial to use a tattle tale or other signaling device to indicate to personnel on or in the vicinity of the rig floor that a droppable object has been successfully launched, and that it has cleared a cement head, thereby reducing the need for the dangerous practice of lifting personnel into the derrick. In such cases, it is critical that a tattle tale or other signaling device provide a clear and accurate indication when a droppable object has been released, and that such droppable object has cleared the body of a cement head.

Figure 1:
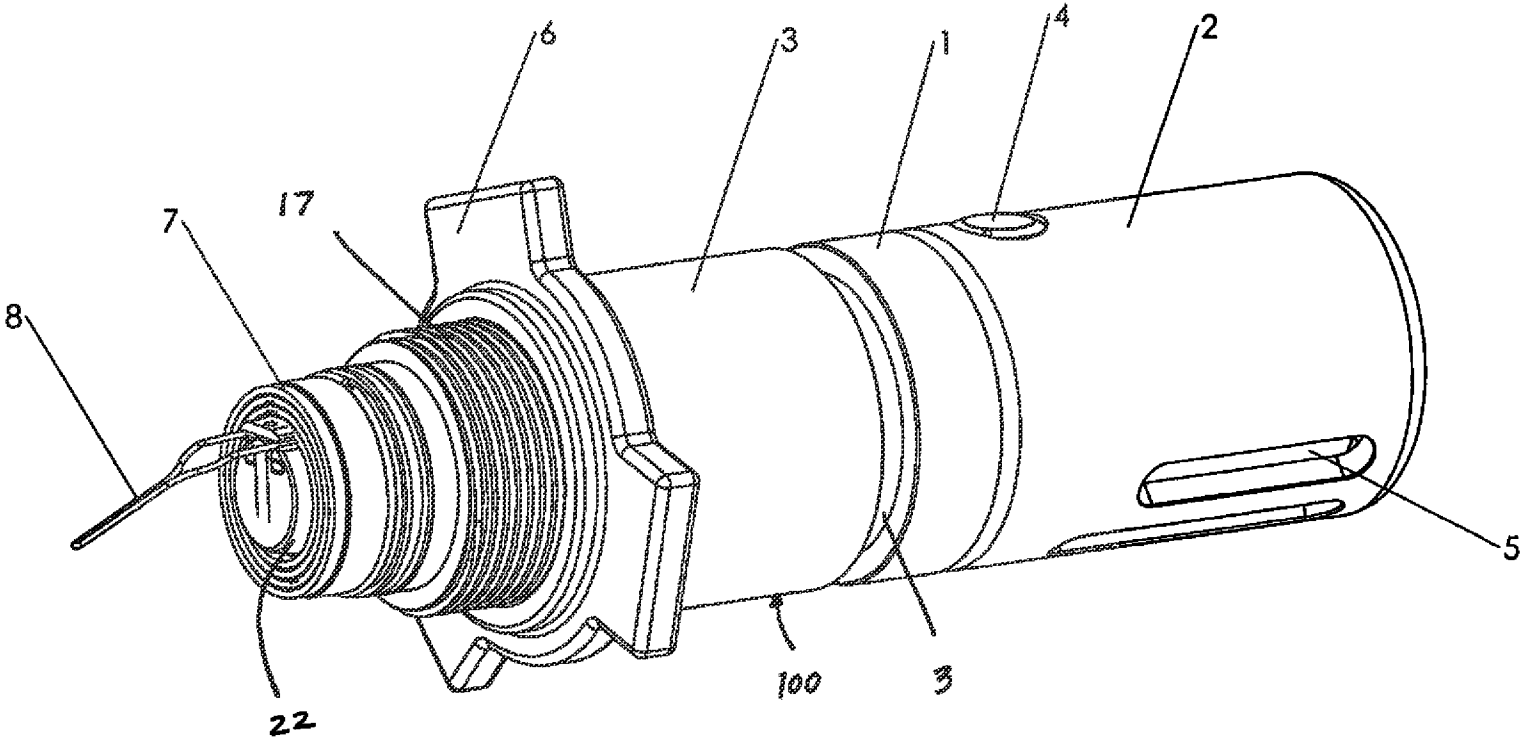
FIG. 1 depicts a side perspective view of a tattle tale assembly of the present invention prior to being installed into a cement head or other tool.

Referring to the drawings, FIG. 1 depicts a perspective view of tattle tale assembly 100 of the present invention having light housing 2, central body 3, threaded section 17 and nose section 22. Light housing nut 1 can be used to secure light housing 2 to body 3. In the preferred embodiment, tattle tale assembly 100 can be installed on a cement head or other similar tool, and is typically mounted so that its longitudinal axis is oriented substantially perpendicular to the longitudinal axis of a central flow bore of said cement head or other tool.

Still referring to FIG. 1, in the preferred embodiment light housing 2 has a plurality of slots 5 disposed around the lower periphery of said light housing 2 to allow light from the LED's (and/or other light sources contained within said housing 2) to be observed by personnel in the vicinity of tattle tale assembly 100, particularly personnel situated on a rig floor below. Switch 4, mounted to housing 2, can be used for selectively powering tattle tale assembly 100 on and off. Central body member 3 contains various items described in more detail below including, without limitation, mechanical and electrical elements integral to the operation of tattle tale assembly 100; a portion of said central body member 3 is beneficially covered by protective cover 13.

Still referring to FIG. 1, although tattle tale assembly 100 of the present invention can be attached to a cement head or other tool in many different ways, it is to be observed that said tattle tale assembly will frequently be partially received within a transverse, threaded bore extending through a side wall of said cement head or other tool. In such cases, threaded section 17 can mate with threads of such a threaded bore of a cement head or other tool, while lock nut 6 can be tightened against said cement head or other tool once tattle tale assembly 100 is correctly positioned in order to secure tattle tale assembly 100 in place. In most cases, tattle tale assembly 100 will be positioned with switch 4 directed substantially upward, and slots 5 directed substantially downward. In the preferred embodiment, rubber boot 7 can be beneficially loaded with grease to prevent well fluids from entering the internal portions of tattle tale assembly 100.

When tattle tale assembly 100 is connected to a cement head or other tool, wire tongue 8 can protrude—at least partially—into a central flow bore of a cement head or other tool. Said wire tongue 8 forms a trigger member and can be deflected downward when a substantial object, such as a dart, plug or ball, passes through the central flow bore of said cement head or other tool. Wire tongue 8 will not deflect and cause a signaling event during standard flow of wellbore fluids through the central flow bore of a cement head or other tool.

Figure 2A:
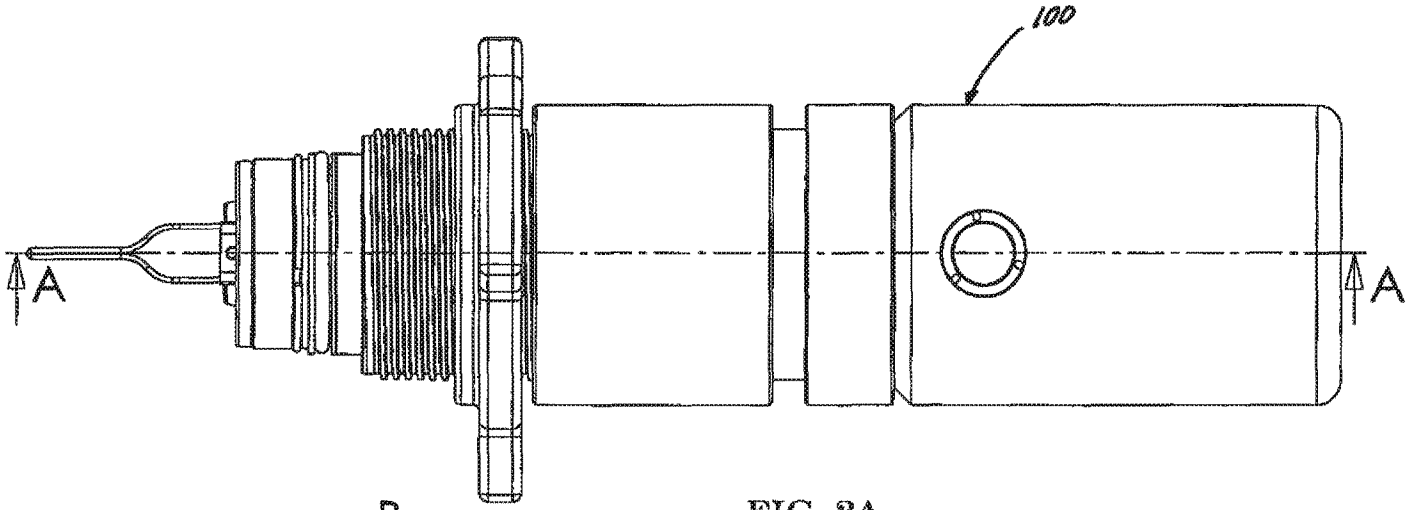
FIG. 2A depicts an overhead view of the tattle tale assembly of the present invention.
Figure 2B:
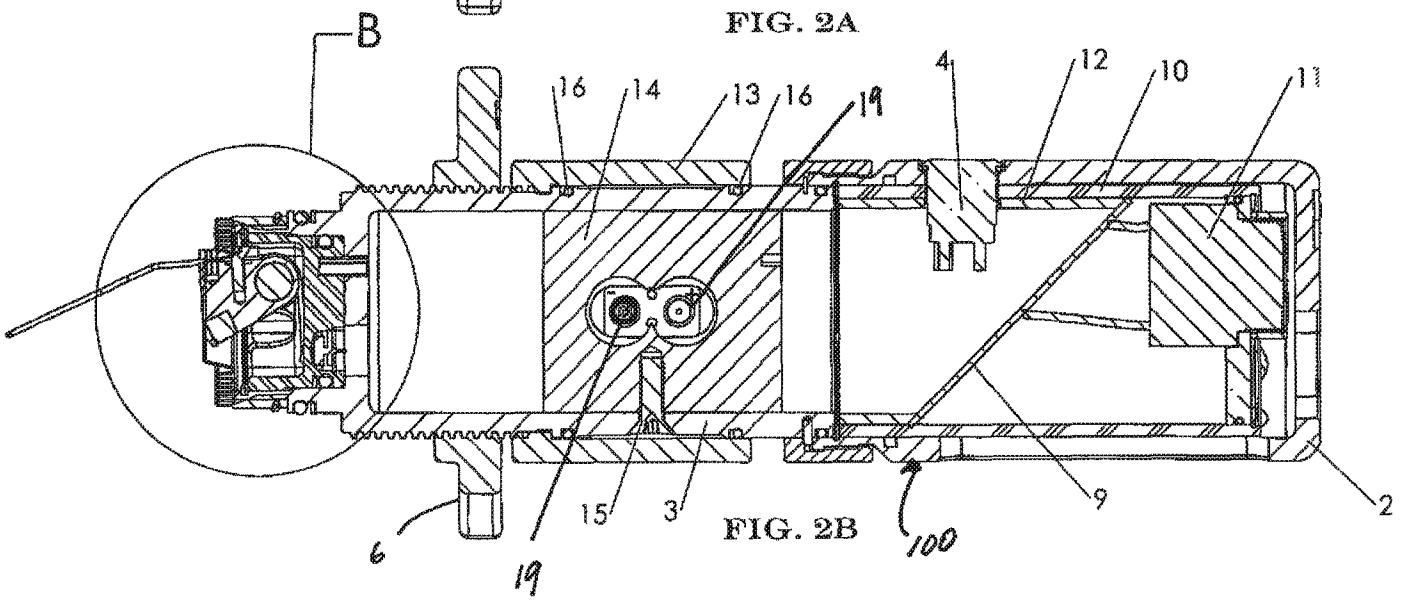
FIG. 2B is the section view of the tattle tale assembly of the present invention along line A-A of FIG. 2.

Referring to FIG. 2A, section line "A-A" extends along the longitudinal axis of tattle tale assembly 100. FIG. 2B depicts a sectional view of tattle tale assembly 100 of the present invention along line "A-A" of FIG. 2A.

In the preferred embodiment, printed circuit board (PCB) 9 is disposed within an internal chamber formed by housing 2. Said housing 2 further contains all LED lamps (not shown) for visual indication to personnel observing said tattle tale assembly 100. In the preferred embodiment, PCB 9 also contains electronics for control and operation of tattle tale assembly 100. Positioning sleeve 12 is affixed to PCB 9 so as to provide a mounting surface. Polycarbonate lens 10 is positioned between positioning sleeve 12 and light housing 2. In the preferred embodiment, polycarbonate lens 10 is frosted and scatters the light emitted from LED's or other light sources when illuminated. In the preferred embodiment, housing 2 also contains a piezo buzzer 11 that provides an audible alarm signal when a desired event occurs.

Central body member 3 of tattle tale assembly 100 includes battery compartment 14 housing batteries 19 that can be wired to PCB 9 via appropriate connectors. Battery compartment 14 can be constructed of PVC or other beneficial material(s) having desired characteristics. Socket screw 15 can be used to secure battery compartment 14 in place within body 3, while battery compartment protective cover 13 can thread onto body 3 to cover batteries 19 in order to protect and contain said batteries 19. O-rings 16 (in the preferred embodiment, 141 o-rings) form a seal between protective cover 13 and body 3, thereby protecting batteries 19 from the surrounding environment (including, without limitation, weather).

Figure 3:
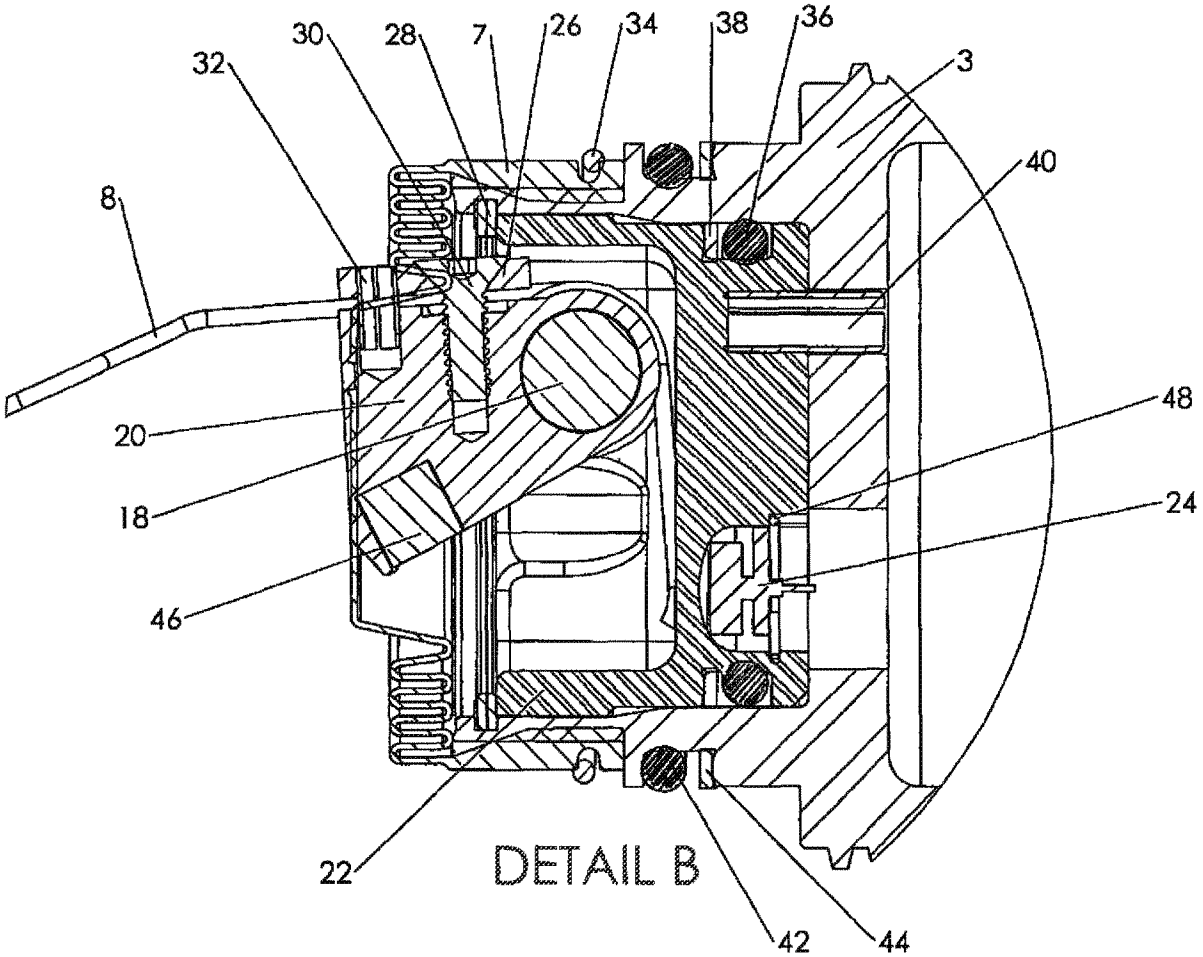
FIG. 3 is a detail view of the nose portion of the tattle tale assembly of the present invention depicted in the highlighted area of FIG. 2B.

FIG. 3 is a detailed view of a portion of tattle tale assembly 100 depicted within encircled section "B" depicted in FIG. 2B. In the preferred embodiment, nose section 22, which can be beneficially constructed of a non-ferrous material such as aluminum, is received within a recess formed by a portion of body member 3. O-ring 36 and back-up ring 38 provide a seal between nose section 22 and body member 3 against high pressure wellbore fluids present in the cement head or other tool. Such seal effectively creates two chambers—a first chamber that is exposed to wellbore fluids (and pressures) in the flow bore of the cement head or other tool, and a second chamber that is isolated from such elevated pressures and is exposed to atmospheric pressure. Spiral retaining ring 28 keeps nose section 22 in place within the recess formed in body member 3. Roll pin 40 can be used to align nose section 22 in radial orientation to body member 3.

Hinge 20 rotates about hinge pin 18 within nose section 22, and provides a mounting surface for circulation loss wire tongue 8. In the preferred embodiment, wire tongue 8 acts a trigger, and can be biased (using a spring or other biasing device) against displacement caused by wellbore fluids flowing through the central flow bore of a cement head or other tool. Such spring or other biasing device helps to ensure that said tongue 8 is not displaced, and that tattle tale assembly 100 does not indicate occurrence of an actual event, unless a droppable object (for example, a ball, dart or plug) passes said tongue 8 and triggers the indicator mechanism of the present invention.

Hinge cap 26 provides a means of securing circulation tongue 8 to hinge 20. Roll pin 40 and a flat head socket screw 30 facilitate hinge cap 26 in holding said circulation loss wire tongue 8 in position on hinge 20. In the preferred embodiment, sensor assembly 24 includes a Hall Effect sensor and is secured in place by circular retaining wire 48 in a recess in nose 22; sensor assembly 24 is within the portion of tattle tale assembly 100 that is exposed to atmospheric pressure (and is isolated from well fluids and elevated pressures).

Magnet 46 is disposed on hinge 20 and positioned such that said magnet 46 will either come within close proximity to sensor assembly 24, or be separated from said sensor assembly—depending upon the position of hinge 20. In the preferred embodiment, boot 7 contains grease to keep said boot from collapsing in on components of the present invention located within the chamber exposed to high pressure wellbore fluids. Boot 7 is secured to body 3 by retaining wire 34, while o-ring 42 and back-up ring 44 provide a pressure and fluid seal between tattle tale assembly 100 and a cement head or other tool to which it is attached.

Figure 4A:
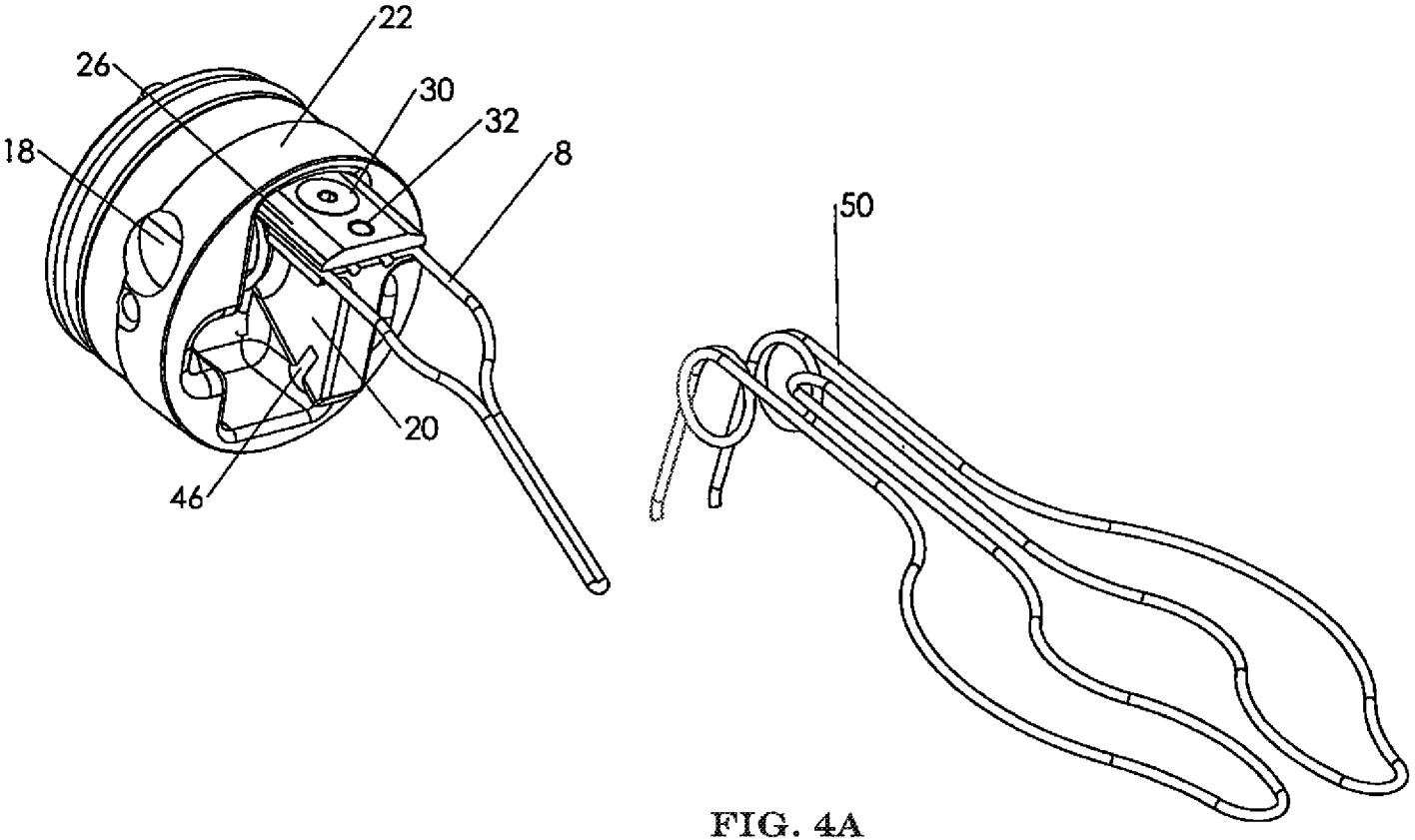
FIG. 4A depicts a perspective view of a portion of the tattle tale apparatus of the present invention, including an alternate wire tongue.
Figure 4B:
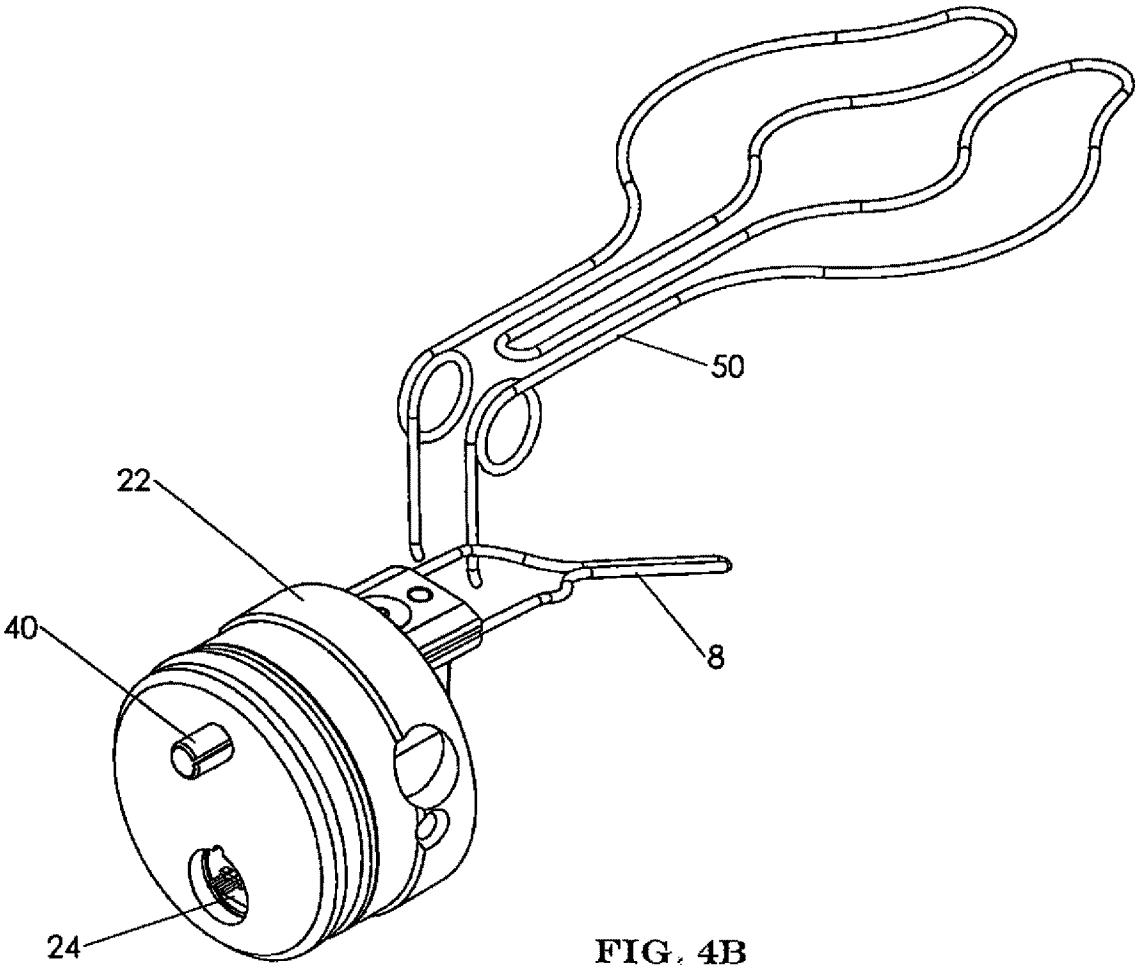
FIG. 4B depicts a perspective view of a portion of the tattle tale apparatus of the present invention, including an alternative wire tongue.

FIG. 4A depicts a perspective view of the front of nose section 22. Alternative embodiment wire tongue 50 is shown. Alternate wire tongue 50, which can be used in place of circulation loss wire tongue 8, can serve as a trigger to cause an event for small objects down to one-inch in diameter intentionally released within a wellbore/FIG. 4B depicts a perspective view of nose section 22 from the opposite perspective the view shown in FIG. 4B.

OPERATION OF A PREFERRED EMBODIMENT

The tattle tale assembly of the present invention is electronic in nature, but uses mechanical means to detect the movement of a dart, plug, or ball past a desired point, described herein as "an event." Relatively delicate sensor components are isolated from harsh wellbore environments and elevated pressures in which mechanical triggering means resides. In other words, a pressure barrier separates the harsh wellbore environment and elevated pressures observed within the central flow bore of a cement head or other tool from less robust sensor components which are maintained at atmospheric pressure.

In the preferred embodiment of the present invention, a mechanical triggering device or tongue (such as circulation loss wire tongue 8) is mounted within a chamber (such as nose section 22) which is substantially open to the wellbore and protrudes into the central flow bore of a cement head or other tool. A deflection of said tongue caused by a passing dart, plug or ball will result in a change in potential at the output of an electronic sensor (like that of the Hall Effect sensor in sensor assembly 24) mounted in a second chamber within the body of the tattle tale assembly of the present inventions.

Dual chambers having a non-magnetic barrier between such chambers resolves sealing issues discussed herein namely, the need to provide a pressure and fluid seal between the pressurized wellbore fluids in the central flow bore of a cement head or other tool, and the atmospheric pressure observed on the outside of said cement head or other tool. A solid barrier is beneficially formed within said tattle tale assembly 100 between the wellbore environment and the portion of said tattle tale assembly 100 that houses less robust components of the device. The non-magnetic barrier of the present invention withstands pressures up to and beyond the maximum pressures observed within the central flow bore of the cement head or tool.

The present invention further teaches several means of causing the sensor on the atmospheric side of the non-magnetic barrier to react to the movement of a triggering device on the wellbore side of said barrier. A preferred method is to use a Hall Effect sensor and a magnet means such as magnet 46. There are at least two positions in the prepared preferred embodiment where said magnet may be placed. One such position is on the trigger device itself so that the triggering of an event will cause the magnet to move close to the Hall Effect sensor, thus causing a change in potential at the sensor. Alternatively, another position is behind the Hall Effect sensor so as to bias the sensor with the presence of a small magnetic field. When a magnetic material such as one containing ferrous is moved toward the sensor from the wellbore side of the barrier, the magnetic field from the magnet changes, thereby causing a change in potential at the output of the sensor.

Another method for detecting movement of the trigger device of tattle tale assembly 100 of the present invention is to use a simple wire coil as a sensor (within the atmospheric pressure "outer" chamber) and the movement of a magnet on the wellbore side of the non-magnetic barrier. In this method, when a magnetic field moves across the coil, a voltage potential is generated. Similar to a configuration wherein a Hall Effect sensor is used with a magnet behind the sensor, a magnet can also be placed within or behind a coil, which in turn allows movement of a ferrous material on the wellbore side to generate a measurable voltage potential across such coil.

The change in potential at the output of any of the variety of sensors including, without limitation, those described herein, is impressed on the input of an electronic circuit (such as the circuitry on PCB 9) that is also located on the atmospheric side of the pressure-tight barrier. The preferred embodiment of the present invention further utilizes a microcontroller to receive an instantaneous signal from the sensor, and then is programmed to provide an indication of a predetermined length of time. The indication may be any of several methods including, without limitation, flashing or steady light emitting diodes, an audible alarm such as piezo buzzer 11, or any combination thereof. Following the predetermined indication period, the microcontroller can be beneficially programmed to automatically reset the tattle tale assembly of the present invention for the next event. In the preferred embodiment, a "ready" status is noted by seeing a slowly flashing light.

The tongue of the present invention is specially designed using flow analysis to insure it will not be triggered by well fluid flow or pressure observed within the flow bore of a cement head or other tool, but will trigger only when droppable objects such as darts, plugs, and balls pass. This requires a careful balance of the tongue area exposed to flow of wellbore fluids within the central bore of a cement head or other tool versus the spring tension opposing it. In one embodiment of the present invention, said tongue can detect any intentionally released object including a ball as small as one inch in diameter and up to and including any object that is capable of passing through the bore of the cement head or other tool. Further, such tongue configuration will not be adversely affected by normal well fluid flow.

In some instances a heavy, stringy substance known as lost circulation loss material can be pumped down the well. Under such conditions, the present invention can utilize an alternative type of triggering device or tongue that will not collect the heavy, stringy media, and thus cause false triggers or events. Such alternative configuration tongue is effective in the presence of darts, plugs, and balls that are larger than three inches in diameter.

In the preferred embodiment of the present invention, status outputs of the microcontroller in addition to the "PASS" mode (rapidly flashing green) and "READY" (slowly flashing amber), can include various other signals such as, for example, low battery indicators (red LED) to advise of the state of battery discharge. The electronic circuitry, including the LEDs, can be beneficially powered by lithium batteries. The tattle tale assembly of the present invention is environmentally secure and is rated as "Zone 0, Explosion Proof" for hazardous locations.

From the description above, a number of advantages of the tattle tale assembly of the present invention are apparent:

1. Total isolation of sensitive electronics from the harsh wellbore environment using a non-magnetic barrier.

2. Multiple methods for providing communication between a mechanical triggering device and a sensor which reacts to a change in a voltage potential.

3. Special triggering devices that are not adversely affected by flow of wellbore fluids within a central bore of a cement head or other tool, yet appropriately trigger an event when a droppable object is launched.

4. Triggering devices that will trigger an event caused by passage of an object as small as one-inch in diameter.

5. Electronic circuitry that provides a means for adjusting or extending the signaling time to a desired length of time.

6. Electronic circuitry that provides a means of automatically resetting the device for another event.

7. Electronic circuitry that provides a means of signaling the battery condition.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A method for signaling passage of an object through a central flow bore of a tool comprising:

a. dropping an object through said central flow bore past an indicating device, wherein said indicating device comprises:

(i) a body member connected to said tool having a first chamber in pressure communication with said central flow bore, a second chamber at substantially atmospheric pressure, and a substantially solid and non-magnetic pressure sealing barrier disposed between said first and second chambers, wherein said barrier isolates said first and second chambers from each other;

(ii) a trigger pivotally mounted within said first chamber, wherein said trigger does not extend beyond said barrier but at least a portion of said trigger extends into said central flow bore;

(iii) a sensor wholly disposed within said second chamber, adapted to sense when said magnetic field changes across said barrier;

b. rotationally displacing said trigger when said launched object passes said trigger, thereby causing a change in magnetic field across said barrier;

c. sensing said change in magnetic field using said sensor; and d. emitting a signal using a signal device.

2. The method of claim 1, wherein only said magnetic field passes through said barrier.

3. The method of claim 1, wherein said pressure sealing barrier can withstand a pressure differential across said barrier equal to at least the working pressure rating of said tool.

4. The method of claim 1, wherein said mechanical trigger comprises a spring wire tongue that when displaced by passage of said launched object causes displacement of a magnet in proximity of said pressure sealing barrier.

5. The method of claim 1, wherein said electronic sensor comprises a Hall-effect sensor that produces either an on or off signal.

6. The method of claim 1, wherein said electronic sensor comprises a wire coil positioned in said second chamber so that movement of a magnet in said first chamber produces an electrical voltage in said wire coil.

7. The method of claim 1, wherein said mechanical trigger comprises a spring wire tongue that when displaced by passage of said launched object causes displacement of a ferrous metal member in proximity to said pressure sealing barrier.

8. The method of claim 1, wherein said electronic sensor comprises a Hall-effect sensor having a biasing magnet incorporated in said Hall-effect sensor.

9. The method of claim 1, wherein said signal comprises an audible sound.

10. The method of claim 1, wherein said signal device comprises at least one light emitting diode adapted to provide a visual signal when said launched object passes said indicating device.

11. The method of claim 1, wherein said trigger comprises a wire configured such that passage of any objects at least 3 inches in diameter will displace said trigger, while loss circulation material will not displace said trigger.

* * * * *